US005842451A

United States Patent [19]

von Eisebeck et al.

[11] Patent Number: 5,842,451

[45] Date of Patent: Dec. 1, 1998

[54] CAMSHAFT DRIVE HOUSING FOR AN INTERNAL COMBUSTION ENGINE

[75] Inventors: Götz Freiherr von Eisebeck, Berlin; René Reif, Aichwald; Rolf Dürrstein, Bietigheim; Robert Ostertag, Tiefenbronn; Martin Weindorf, Kornwestheim, all of Germany

[73] Assignee: Daimler-Benz AG, Stuttgart, Germany

[21] Appl. No.: 969,498

[22] Filed: Nov. 13, 1997

[30] Foreign Application Priority Data

Nov. 15, 1996 [DE] Germany ..... 196 47 299.7

[51] Int. Cl.[6] ..... F02F 7/00; F01M 1/00

[52] U.S. Cl. ..... 123/196 R; 123/198 C; 123/195 C

[58] Field of Search ..... 123/90.33, 90.38, 123/195 C, 196 R, 196 A, 198 C; 184/6.5

[56] References Cited

U.S. PATENT DOCUMENTS

| | | | |
|---|---|---|---|
| 4,538,565 | 9/1985 | Hidaka et al. | 123/196 R |
| 4,827,881 | 5/1989 | Baker et al. | 123/196 R |
| 5,063,895 | 11/1991 | Ampferer | 123/198 C |
| 5,085,187 | 2/1992 | Black | 123/198 C |
| 5,113,807 | 5/1992 | Kobayashi | 123/198 C |
| 5,152,264 | 10/1992 | Evans | 123/198 C |
| 5,195,479 | 3/1993 | Hasetoh et al. | 123/198 C |

FOREIGN PATENT DOCUMENTS

| | | |
|---|---|---|
| 2 556 775 | 6/1985 | France . |
| 42 11 896 | 10/1993 | Germany . |
| 43 12 200 | 7/1994 | Germany . |

*Primary Examiner*—Weilun Lo
*Attorney, Agent, or Firm*—Klaus J. Bach

[57] ABSTRACT

In a camshaft drive housing for an internal combustion engine supporting auxiliary equipment, an oil pump is mounted in the housing cover and driven by the engine crankshaft. It supplies oil under pressure to an oil filter also mounted on the camshaft drive housing and the pressure of the oil leaving the oil filter is communicated back to the oil pump by way of a passage extending through the housing cover for controlling the oil pump.

3 Claims, 2 Drawing Sheets

CAMSHAFT DRIVE HOUSING FOR AN INTERNAL COMBUSTION ENGINE

BACKGROUND OF THE INVENTION

The invention relates to a camshaft drive housing for an internal combustion engine adapted to support auxiliary equipment such as an oil pump, which is arranged in a chamber of a cavity formed by the drive housing cover.

DE 42 11 896 C2 discloses a camshaft drive housing with a housing cover, which is shaped such that it is relatively simple in design, but can accommodate auxiliary equipment units in an optimal arrangement with respect to each other. To this end, the housing cover includes a space which is divided into various chambers in which auxiliary equipment such as an oil pump, a coolant pump or a thermostatic valve are disposed, the various chambers being in communication with one another by flow passages. Outside the hollow space, the cover includes support structures for supporting additional auxiliary equipment.

However, the arrangement has a disadvantage in that it needs external drive means for operating the oil pump.

It is the object of the present invention to improve the cover of such a camshaft drive housing such that oil circulation in the housing cover is optimized, particularly such that the oil pump is better integrated into the oil circuit.

SUMMARY OF THE INVENTION

In a camshaft drive housing for an internal combustion engine-including supporting auxiliary equipment, an oil pump is mounted in the housing and is driven by the engine crankshaft. It supplies oil under pressure to an oil filter also mounted on the camshaft drive housing and the pressure of the oil leaving the oil filter is communicated back to the oil pump by way of a return passage extending through the housing cover for controlling the oil pump.

By way of the return passage, the oil pump can be controlled in a simple manner by oil from the oil circuit within the camshaft drive housing of the internal combustion engine. There is therefore no need for external pipes and/or control members for the oil pump.

Advantageous embodiments of the invention will be apparent from the following description on the basis of the accompanying drawings.

DESCRIPTION OF A PREFERRED EMBODIMENT

Figure 2:
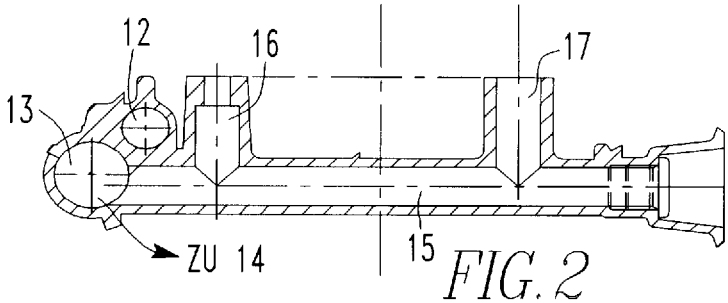
FIG. 2 is a cross-sectional view taken along line II—II of FIG. 1.
Figure 1:
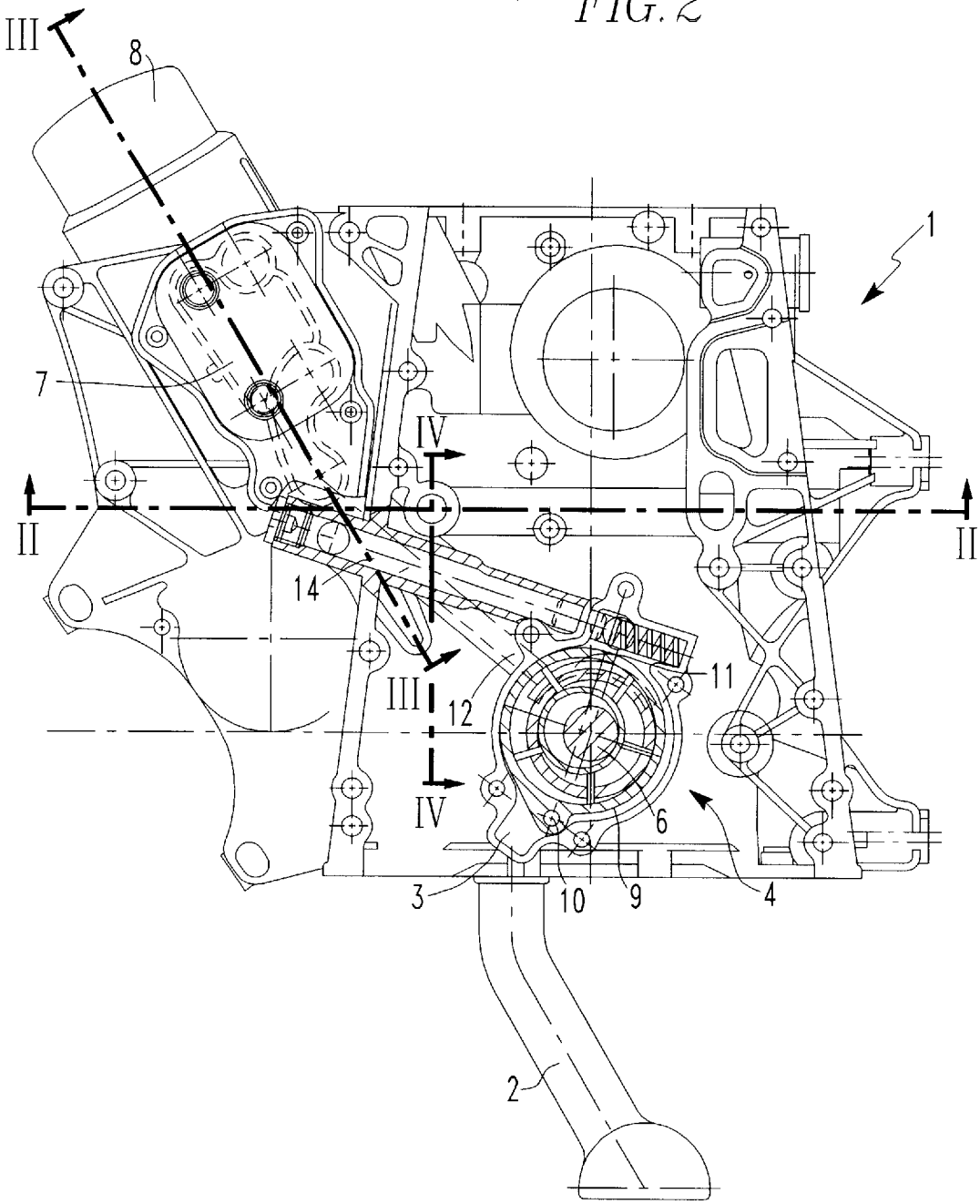
FIG. 1 shows a camshaft drive housing with auxiliary equipment integrated therein.
Figure 3:
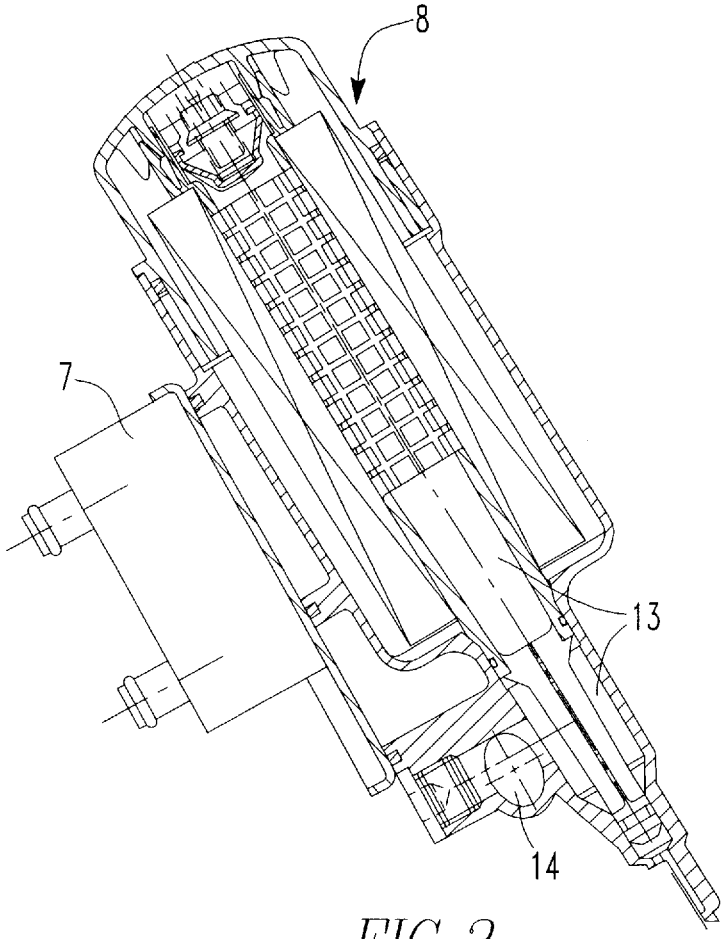
FIG. 3 is a cross-sectional view taken along line III—III of FIG. 1.

In the camshaft drive housing 1 as shown in FIG. 1, there is an oil circuit provided as follows:

Oil is sucked in through a plastic-molded oil suction pipe 2 including a sieve (not shown) to the suction side 3 of a controllable oil pump, which is shown as a rotary vane pump 4. The rotary vane pump 4 is integrated into the camshaft drive housing 1 and is driven by a crank shaft 6.

The drive housing 1 further includes an oil cooler 7 and an oil filter 8. The oil flow volume supplied by the oil pump 4 is automatically controlled depending on the oil pressure after the oil cooler and the oil filter 8 by adjusting the position of an outer pump ring 9, which is pivotally supported on a bolt 10 in a manner known in connection with such pumps.

The oil is supplied from the pressure side 11 of the rotary vane pump 4 to the oil cooler 7 by way of an inclined passage 12. After passing through the oil cooler 7, the oil flows through the oil filter 8.

From the clean oil side, that is the discharge side, 13 of the oil filter 8, a passage 14 extends to the rotary vane pump 4 along a path which is inclined downwardly toward the pump 4, whereby the oil pressure is supplied to the oil pump for controlling the pump 4. The pump 4 is controlled in the usual way by a change of the oil pressure, which is effective on the outer ring 9 of the pump 4 by way of the oil pressure communication passage 14. The communication passage 14 may be a bore extending through a wall portion of the camshaft drive housing 1.

The major part of the oil, which leaves the filter and does not enter the passage 14 reaches, by way of the discharge side 13, a distribution channel 15 from where the oil is distributed to two oil supply passages 16 and 17 leading to the cylinder crankcase, which is not shown in the drawings.

Figure 4:
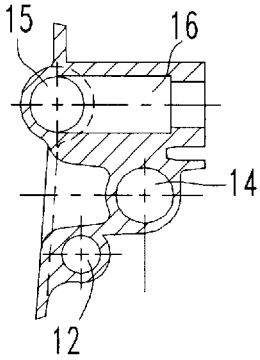
FIG. 4 is a cross-sectional view taken along line IV—IV of FIG. 1.

FIG. 4 is a detail view showing more clearly the inclined passage 12, the passage 14, and one of the oil supply passages 16.

What is claimed is:

1. A camshaft drive housing for an internal combustion engine, said camshaft drive housing supporting auxiliary equipment including an oil pump, said housing defining a hollow space with chambers for receiving said auxiliary equipment, said oil pump being supported in one of said chambers, and an oil filter being mounted on said camshaft drive housing, and said chambers being in communication with one another by oil flow passages, said oil filter having a clean oil discharge side, band one of said oil flow passages being a communication passage extending from said clean oil discharge side of said oil filter to said oil pump for controlling said oil pump.

2. A camshaft drive housing according to claim 1, wherein said communication passage extends from said clean oil discharge side of said oil filter downwardly to said oil pump at an inclination with respect to a horizontal plane.

3. A camshaft drive housing according to claim 1, wherein said oil pump is a controllable rotary vane pump.

* * * * *